US005619478A

United States Patent [19]

Mutoh

[11] Patent Number: 5,619,478

[45] Date of Patent: Apr. 8, 1997

[54] ANALOG TIMEPIECE HAVING MEANS FOR SIGNALING AN ALARM TIME AND A CHANGE OF MODE

[75] Inventor: Atsushi Mutoh, Chiba, Japan

[73] Assignee: Seiko Instruments Inc., Japan

[21] Appl. No.: 507,041

[22] Filed: Jul. 25, 1995

[30] Foreign Application Priority Data

Jul. 26, 1994 [JP] Japan ..... 6-174544

[51] Int. Cl.[6] ..... G04B 23/02

[52] U.S. Cl. ..... 368/72; 368/76; 368/223; 368/243

[58] Field of Search ..... 368/80, 243, 72, 368/229, 74, 66

[56] References Cited

U.S. PATENT DOCUMENTS

| | | | |
|---|---|---|---|
| 4,223,522 | 9/1980 | Nomura et al. | 368/66 |
| 4,253,172 | 2/1981 | Nomura | 368/72 |
| 4,421,420 | 12/1983 | Ushikoshi | 368/229 |
| 4,470,707 | 9/1984 | Chambon et al. | 368/74 |
| 4,474,480 | 10/1984 | Kato | 368/80 |
| 5,379,281 | 1/1995 | Koch | 368/72 |

*Primary Examiner*—Bernard Roskoski
*Attorney, Agent, or Firm*—Adams & Wilks

[57] ABSTRACT

An analog electronic timepiece having a function by use of which a plurality of predetermined times as well as a mode change can be visually informed so that they are easily understood by hand movement and sound generation. When a judgement circuit judges a predetermined condition of the timepiece, such as time coincidence with a preset alarm time and/or mode change, the judgement circuit outputs a starting signal of the hand movement and sound generation. An information signal generation circuit produces timing signals for driving the hands and generating sound in response to the starting signal. An information signal generating circuit outputs an operation generation signal to a motor driving circuit and/or a sound signal generating circuit according to preselected numbers of hand movement operation steps and frequencies of sound generation read out from an information operation storing circuit. Thus, the analog electronic timepiece can inform the predetermined condition of the timepiece not only an audible by sound but visually by movement of the hands.

18 Claims, 11 Drawing Sheets

| REPETITION NUMBER (TIMES) | HAND MOVEMENT STEP | M2 MINUTE HAND (STEPS) | M1 HOUR HAND (STEPS) | BUZZER 1 FREQ. A (msec) | BUZZER 2 FREQ. B (msec) |
|---|---|---|---|---|---|
| H | 601 | 25F *1 | | | |
| | | | | 718.75EMB | |
| WAIT 0.5 sec | | | | | |
| 3 | 602 | 10F | 10B | | |
| | | 10B | 10F | | |
| | | | | 718.75EMB | |
| 1 | 603 | *2 | *2 | | |
| WAIT 0.5 sec | | | | | |
| 4 | 604 | 20B | 20F | | |
| | | | | 1 SHOT | |
| | | 20F | 20B | | |
| | | | | | 1 SHOT |
| WAIT 0.5 sec | | | | | |
| 1 | 605 | *2 | *2 | | |

1 SHOT : SHOT SOUND OF 31.25 msec
F : CLOCKWISE REVOLUTION (32Hz)
B : COUNTERCLOCKWISE REVOLUTION (32Hz)
718.75EMB : ENVELOPE SOUND OF 718.75 msec
h : NUMBER OF THE EXACT HOUR
*1 : REPETITION NUMBER DEPENDS ON THE NUMBER OF "H"
*2 : STEP NUMBER DEPENDS ON THE EXACT HOUR

FIG. 7

| REPETITION NUMBER (TIMES) | HAND MOVEMENT STEP | M2 MINUTE HAND (STEPS) | M1 HOUR HAND (STEPS) | BUZZER 1 FREQ. A (msec) | BUZZER 2 FREQ. B (msec) |
|---|---|---|---|---|---|
| H | 601 | 25F *1 | | | |
| | | | | 718.75EMB | |
| WAIT 0.5 sec | | | | | |
| 3 | 602 | 10F | 10B | | |
| | | 10B | 10F | | |
| | | | | 718.75EMB | |
| 1 | 603 | *2 | *2 | | |
| WAIT 0.5 sec | | | | | |
| 4 | 604 | 20B | 20F | | |
| | | | | 1 SHOT | |
| | | 20F | 20B | | |
| | | | | | 1 SHOT |
| WAIT 0.5 sec | | | | | |
| 1 | 605 | *2 | *2 | | |

1 SHOT : SHOT SOUND OF 31.25 msec
F : CLOCKWISE REVOLUTION (32Hz)
B : COUNTERCLOCKWISE REVOLUTION (32Hz)
718.75EMB : ENVELOPE SOUND OF 718.75 msec
h : NUMBER OF THE EXACT HOUR
*1 : REPETITION NUMBER DEPENDS ON THE NUMBER OF "H"
*2 : STEP NUMBER DEPENDS ON THE EXACT HOUR

ANALOG TIMEPIECE HAVING MEANS FOR SIGNALING AN ALARM TIME AND A CHANGE OF MODE

BACKGROUND OF THE INVENTION

This invention relates to an analog electronic timepiece which uses hands as a means for indicating time.

In a conventional analog electronic timepiece, as a means for informing a predetermined time, a mode change, etc. a method of generating a shot sound and a method of generating a sound or of outputting a melody sound in interlocking relation to the motion of a marionette are known.

Further, a melody clock has also been known which is designed to drive the hands in synchronism with the scale of a melody by a key input signal or a coincidence input signal corresponding to an alarm setting time so that the hands may point to a position on a pictorial design of a score or keyboard provided in a predetermined position on the timepiece face (Japanese unexamined patent publication (Kokai) No. S59-63585(1984).

However, conventional analog electronic timepieces have had the problem that the information of a predetermined time or mode change by use of a shot sound has been executed by sound generation alone and therefore has been difficult to know visually.

Further, the informing of time by a marionette clock is accompanied by complexity of the mechanism of the timepiece, posing the problem that the timepiece has become difficult to miniaturize.

SUMMARY OF THE INVENTION

It is an object of the present invention, in a relatively small-sized timepiece such as a wrist watch, to provide a timepiece which enables predetermined times such as hours, mode change, etc. to be informed so that it is visually easy to understand.

In order to achieve the above object, in the present invention, an analog electronic timepiece comprises: at least two hands for indicating time; at least one motor for driving the hands; at least one motor driving circuit for driving the motor; a mode change key for manually inputting a mode of the timepiece, and outputting a mode change signal; a sound signal generating circuit for outputting a sound generating signal to a speaker to generate a sound; an oscillation circuit for oscillating and outputting a standard signal; a frequency dividing circuit for frequency dividing the standard signal outputted from the oscillation circuit into predetermined frequency signals; a clock circuit for counting time information in response to the predetermined frequency signals outputted from the frequency dividing circuit; a time information signal generating circuit for outputting an operation signal for informing the time information to the motor driving circuit and sound signal generating circuit in response to the time information counted by the clock circuit; a judgement circuit for judging a predetermined condition of the timepiece to output a starting signal of hand movement and generation of sound corresponding to the predetermined condition; an information operation storing circuit for storing and reading out a preselected numbers of hand movement operation steps and frequencies of sound generation; and an information signal generating circuit for producing timing signals for driving the hands and generating sound in response to the starting signal, and outputting an operation generation signal to the motor driving circuit and/or the sound signal generating circuit according to the preselected numbers and frequencies read out from the information operation storing circuit.

In the above described structure, when the judgement circuit judges a predetermined condition of the timepiece, the judgement circuit outputs the starting signal of the hand movement and sound generation.

The information signal generation circuit produces timing signals for driving the hands and generating sound in response to the starting signal. The information signal generating circuit outputs the operation generation signal to the motor driving circuit and/or the sound signal generating circuit according to the preselected numbers of hand movement operation steps and frequencies of sound generation read out from the information operation storing circuit.

Thus, the analog electronic timepiece according to the present invention can inform the predetermined condition of the timepiece not only an audible by sound but also visually by hands movement.

There are several conceptual examples of the present invention as follows:

(1) FIRST EXAMPLE

In the first example, referring to FIG. 1, the judgement circuit is a time coincidence circuit 104 for judging that the time information caused by a clock circuit 103 has coincided with a preset time, and for outputting a starting signal of a time coincidence operation. The information operation storing circuit is a time coincidence operation storing circuit 106 for storing and reading out preselected numbers and frequencies for a time coincidence operation. The information signal generating circuit is a time coincidence signal generating circuit 105 for producing timing signals, and outputting a time coincidence operation signal.

In FIG. 1, an oscillation circuit 101 oscillates a standard signal and outputs to a frequency dividing circuit 102.

The frequency dividing circuit 102 frequency divides the output signal from the oscillation circuit 101 and outputs a predetermined frequency signal.

A clock circuit 103 inputs the frequency signal outputted from the frequency dividing circuit 102 and counts time information.

A time information signal generating circuit 112 inputs the time information counted by the clock circuit 103 and outputs an operation signal for informing time information to a motor driving circuit 107 or sound signal generating circuit 110.

A time coincidence circuit 104 judges that the time information counted by the clock circuit 103 has coincided with a predetermined plurality of times and outputs a starting signal of hand movement and sound generation to a time coincidence signal generating circuit 105.

A time coincidence operation storing circuit 106 previously stores, and enables reading out of, the number of hand movement operation steps of the hands 109 and the number of times of sound generation.

Upon input of a signal for starting movement of the hands 109 and generating a sound which is outputted from the time coincidence circuit 104, the time coincidence signal generating circuit 105 produces timings for the movement of the hands 109 and the generation of the sound by means of the frequency signal produced by the frequency dividing circuit 102, performs judgment as to whether the hands 109 are to be driven or the sound is to be generated according to a predetermined timing stored in the time coincidence operation storing circuit 106, and then outputs an operation signal to either the motor driving circuit 107 or the sound signal generating circuit 110.

The motor driving circuit 107 inputs a hand driving operation signal outputted from the time coincidence signal generating circuit 105 and outputs a signal for driving the hands 109 to a motor 108.

The hands 109 indicate time information or function information pertaining to the timepiece.

The motor 108 inputs the hand driving signal from the motor driving circuit 107 and drives the hands 109.

The sound signal generating circuit 110 inputs a sound generation signal outputted from the time coincidence signal generating circuit 105 to generate sound by outputting a sound generating signal to a speaker 111.

(2) SECOND EXAMPLE

In the second example, referring to FIG. 2, the judgement circuit is a mode change circuit 204 for judging that the mode change signal has outputted from a mode change key 213, and outputting a starting signal of a mode change operation. The information operation storing circuit is a mode change operation storing circuit 206 for storing and reading out preselected numbers and frequencies for a mode change operation. The information signal generating circuit is a mode change signal generating circuit 205 for producing timing signals, and outputting a mode change operation signal.

In FIG. 2, an oscillation circuit 201 oscillates a standard signal and outputs to a frequency dividing circuit 202.

The frequency dividing circuit 202 inputs the output signal from the oscillation circuit 201 to frequency divide it and outputs a predetermined frequency signal.

A clock circuit 203 inputs a frequency signal outputted from the frequency dividing circuit 202 and counts time information.

A time information signal generating circuit 212 inputs time information from the clock circuit 203 and mode information of the timepiece from a mode change circuit 204, and outputs an operation signal for informing time information or function information pertaining to the timepiece to a motor driving circuit 207 or sound signal generating circuit 210.

A mode change key 213 inputs the mode of the timepiece.

A mode display element 214 displays mode information inputted from the mode change key 213.

A mode change circuit 204 outputs to the time information signal generating circuit 212 the mode information signal inputted from the mode change key 213 and outputs to a mode change signal generating circuit 205 a starting signal of a mode change operation by hand movement and sound generation.

A mode change operation storing circuit 206 previously stores, and enables reading out of, the number of hand movement operation steps of the hands 209 and the number of times of sound generation.

Upon input of the starting signal for hand movement and sound generation which is outputted from the mode change circuit 204, the mode change signal generating circuit 205 prepares timings for the driving of the hands 209 and for generating the sound by means of the frequency signal produced by the frequency dividing circuit 202, performs judgment as to whether the hands 209 are to be driven or the sound is to be generated according to a predetermined timing stored in the mode change operation storing circuit 206, and outputs an operation signal to the motor driving circuit 207 or sound signal generating circuit 210.

The motor driving circuit 207 inputs a hand driving operation signal outputted from the mode change signal generating circuit 205 and outputs a signal for driving the hands 209 to a motor 208.

The hands 209 indicate time information or function information pertaining to the timepiece.

The motor 208 inputs a hand driving signal from the motor driving circuit 207 and drives the hands 209.

The sound signal generating circuit 210 inputs a sound generation signal outputted from the time coincidence signal generating circuit 205 to generate the sound by outputting a sound generating signal to a speaker 211.

(3) THIRD EXAMPLE

The third example, referring to FIG. 3, is a combination of the above described first and second examples.

Namely, the judgement circuit comprises a time coincidence circuit 304 for judging that the time information caused by a clock circuit 303 has coincided with a preset time and for outputting a starting signal of a time coincidence operation, and a mode change circuit 314 for judging that the mode change signal has outputted from a mode change key 313 and for outputting a starting signal of a mode change operation. The information operation storing circuit comprises a time coincidence operation storing circuit 306 for storing and reading out preselected numbers and frequencies for a time coincidence operation, and a mode change operation storing circuit 321 for storing and reading out preselected numbers and frequencies for a mode change operation. The information signal generating circuit comprises a time coincidence signal generating circuit 305 for producing timing signals and for outputting a time coincidence operation signal, and a mode change signal generating circuit 316 for producing timing signals and for outputting a mode change operation signal.

Further, the third example includes an operation selection circuit 320, which inputs the time coincidence operation signal outputted from the time coincidence signal generating circuit 305, and which inputs the mode change operation signal outputted from the mode change signal generating circuit 316, for judging which operation is to be preferentially executed, and for outputting an operation generating signal to the motor driving circuit 307 and/or the sound signal generating circuit 310.

In FIG. 3, an oscillation circuit 301 oscillates a standard signal and outputs to a frequency dividing circuit 302.

The frequency dividing circuit 302 inputs the output signal from the oscillation circuit 301 to frequency divide it and outputs a predetermined frequency signal.

The clock circuit 303 inputs the frequency signal outputted from the frequency dividing circuit 302 and counts time information.

A time information signal generating circuit 312 inputs time information counted by the clock circuit 303 and outputs an operation signal for informing time information to the motor driving circuit 307 or the sound signal generating circuit 310.

A time coincidence circuit 304 judges that the time information counted by the clock circuit 303 has coincided with a desired one of a plurality of preset times and outputs a starting signal of hand movement and sound generation to the time coincidence signal generating circuit 305.

The time coincidence operation storing circuit 306 previously stores, and reads out of, the number of hand movement operation steps of the hands 309 and the number of times of sound generation of the sound.

The time information signal generating circuit 312 inputs time information from the clock circuit 303 and mode information of the timepiece from the mode change circuit 314 and outputs an operation signal for informing time information or function information pertaining to the timepiece to the motor driving circuit 303 or sound signal generating circuit 310.

Upon input of the starting signal of hand movement and sound generation which is outputted from the time coincidence circuit 304, the time coincidence signal generating circuit 305 produces timings for the driving of the hands 309 and the generating of the sound by means of a frequency signal produced by the frequency dividing circuit 302, performs judgment as to whether the hands 309 are to be driven or the sound is to be generated according to a predetermined timing stored in the time coincidence operation storing circuit 306, and outputs a time coincidence operation signal to an operation selection circuit 320.

The mode change key 313 inputs a mode of the timepiece.

A mode display element 315 displays mode information inputted from the mode change key 313.

The mode change circuit 314 outputs the mode information signal to the time information signal generating circuit 312 inputted from the mode change key 313, and outputs a starting signal of a mode change operation by hand movement and sound generation to the mode change signal generating circuit 316.

The mode change operation storing circuit 321 previously stores, and enables reading out of, the number of hand movement operation steps of the hands 309 and the number of times of sound generation of the sound.

Upon input of the starting signal of hand movement and sound generation which is outputted from the mode change circuit 314, the mode change signal generating circuit 316 produces timings for driving of the hands 309 and for generating the sound according to the frequency signal produced by the frequency dividing circuit 302, performs judgment as to whether the hands 309 are to be driven or the sound is to be generated according to a predetermined timing stored in the mode change operation storing circuit 321, and outputs a mode change operation signal to the operation selection circuit 320.

The operation selection circuit 320 inputs the mode change operation signal outputted from the mode change signal generating circuit 316 and the time coincidence operation signal outputted from the time coincidence signal generating circuit 305 and judges which operation is to be preferentially executed, outputting an operation signal to the motor driving circuit 307 or to the sound signal generating circuit 310.

The motor driving circuit 307 inputs a hand driving operation signal outputted from the mode change signal generating circuit 316 and outputs a signal for driving the hands 309 to a motor 308.

The motor driving circuit 307 inputs a hand driving operation signal outputted from the operation selection circuit 320 and outputs a signal for driving the hands 309 to the motor 308.

The hands 309 indicate time information or function information pertaining to the timepiece.

The motor 308 inputs a hand driving signal from the motor driving circuit 307 and drives the hands 309.

The sound signal generating circuit 310 inputs a sound generation signal outputted from the operation selection circuit 320 to generate the sound by outputting a sound generating signal to a speaker 311.

BRIEF DESCRIPTION OF THE DRAWINGS

FIG. 7 shows a table of operational steps of the first embodiment of the present invention;

DETAILED DESCRIPTION OF THE PREFERRED EMBODIMENTS

Embodiments of the present invention will be described hereunder based on the drawings.

(1) First Embodiment of the Present Invention

Figure 1:
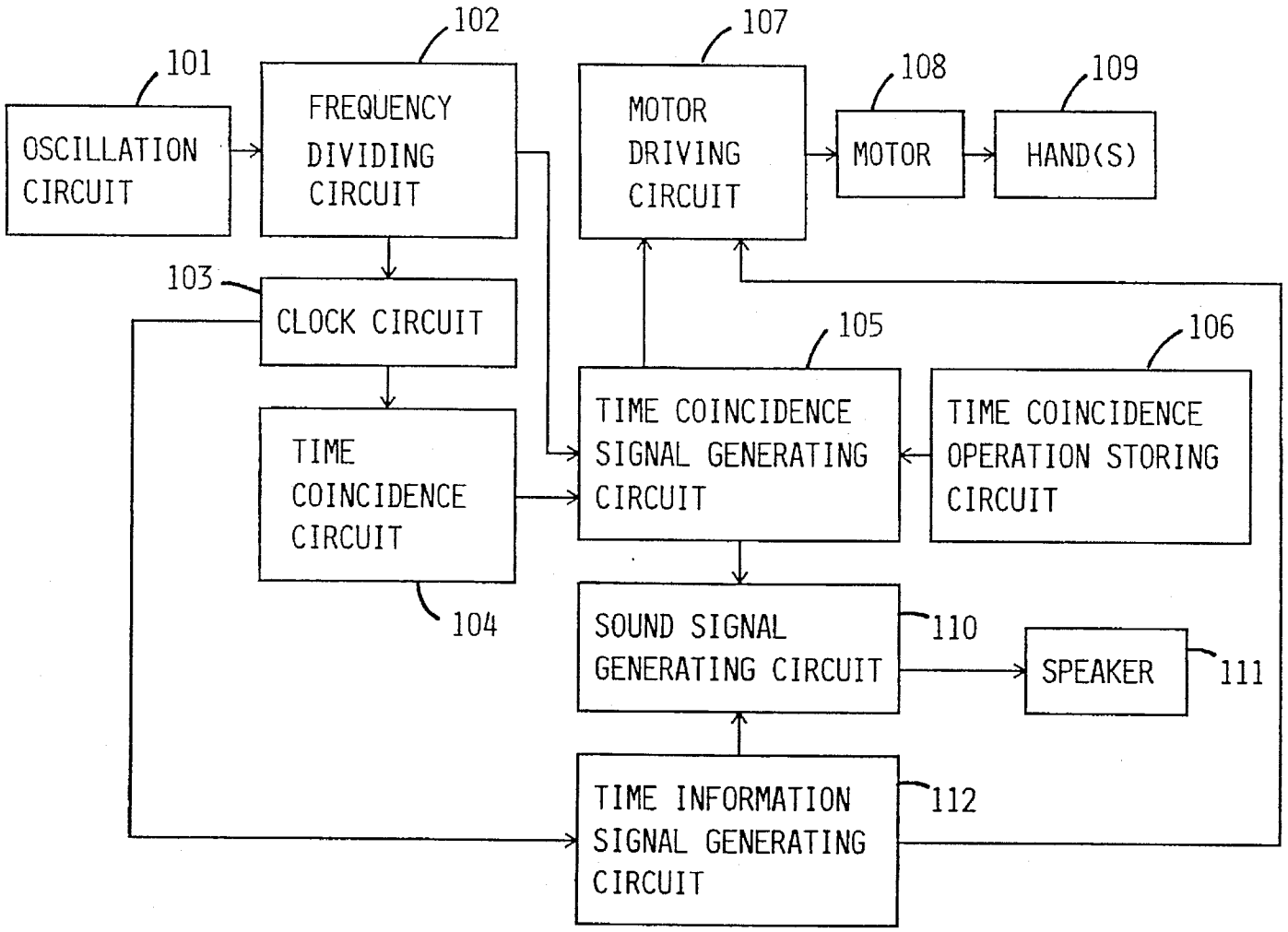
FIG. 1 shows a block diagram of a first example of the present invention.
Figure 2:
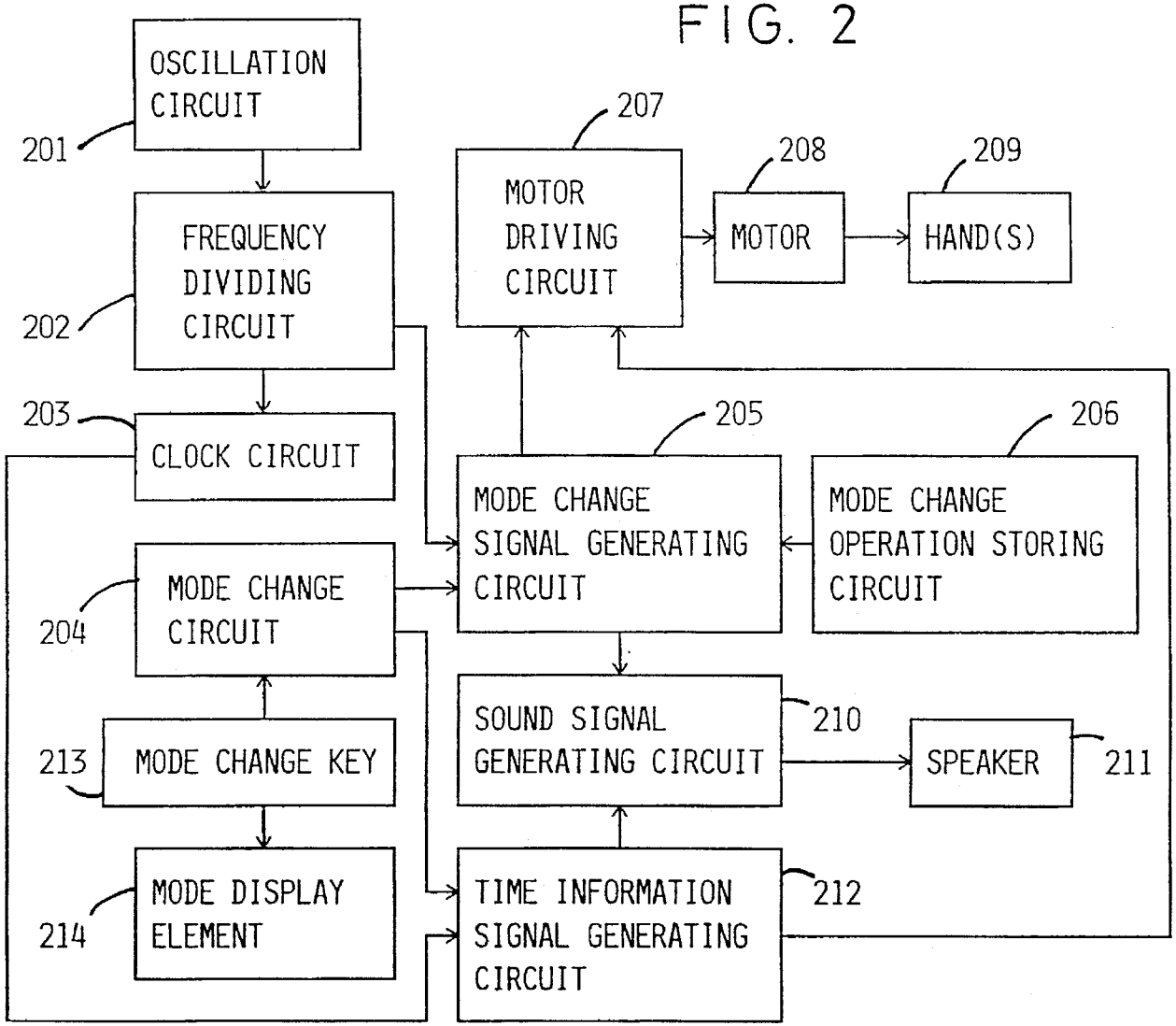
FIG. 2 shows a block diagram of a second example of the present invention.
Figure 3:
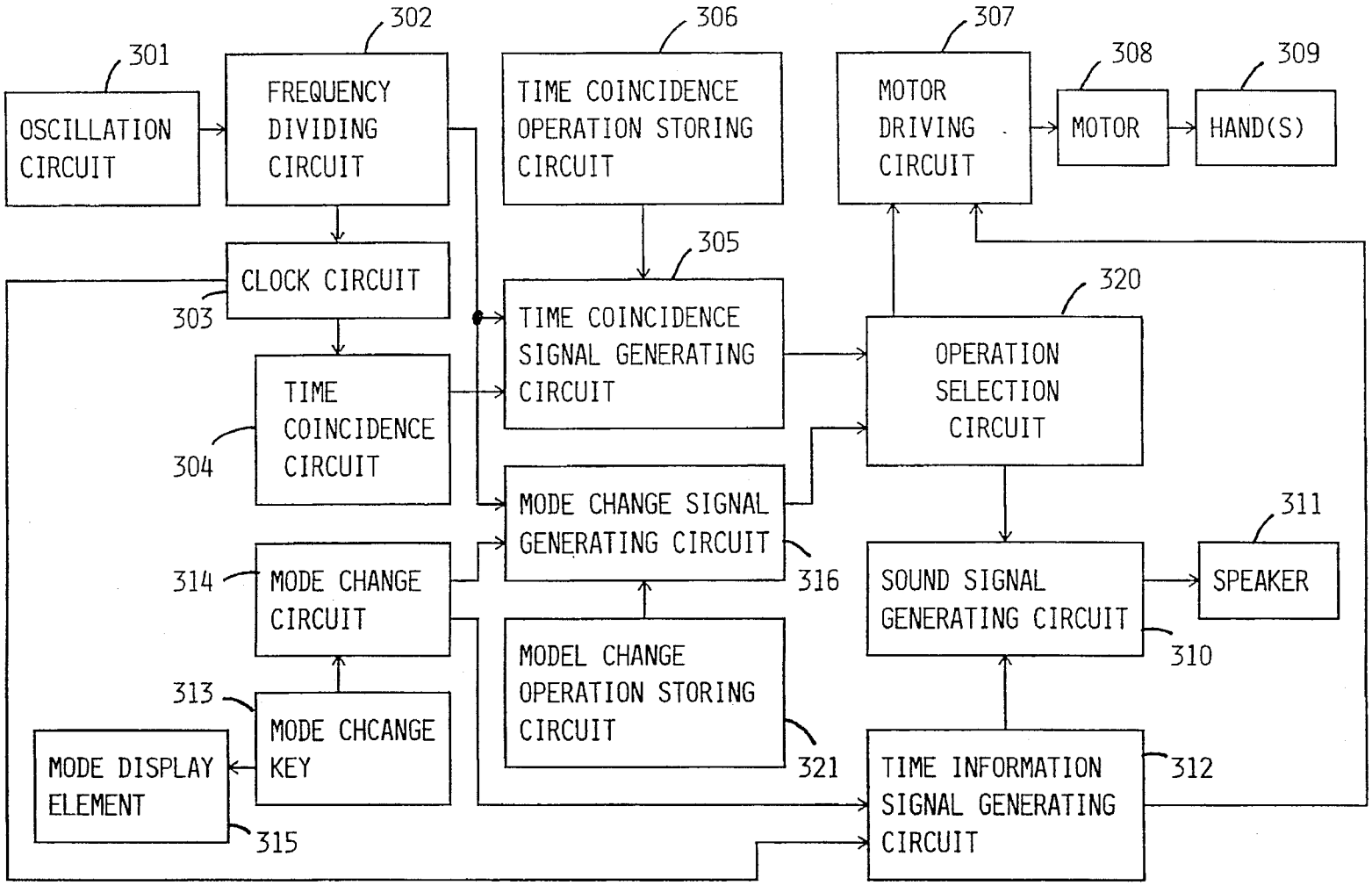
FIG. 3 shows a block diagram of a third example of the present invention.
Figure 4:
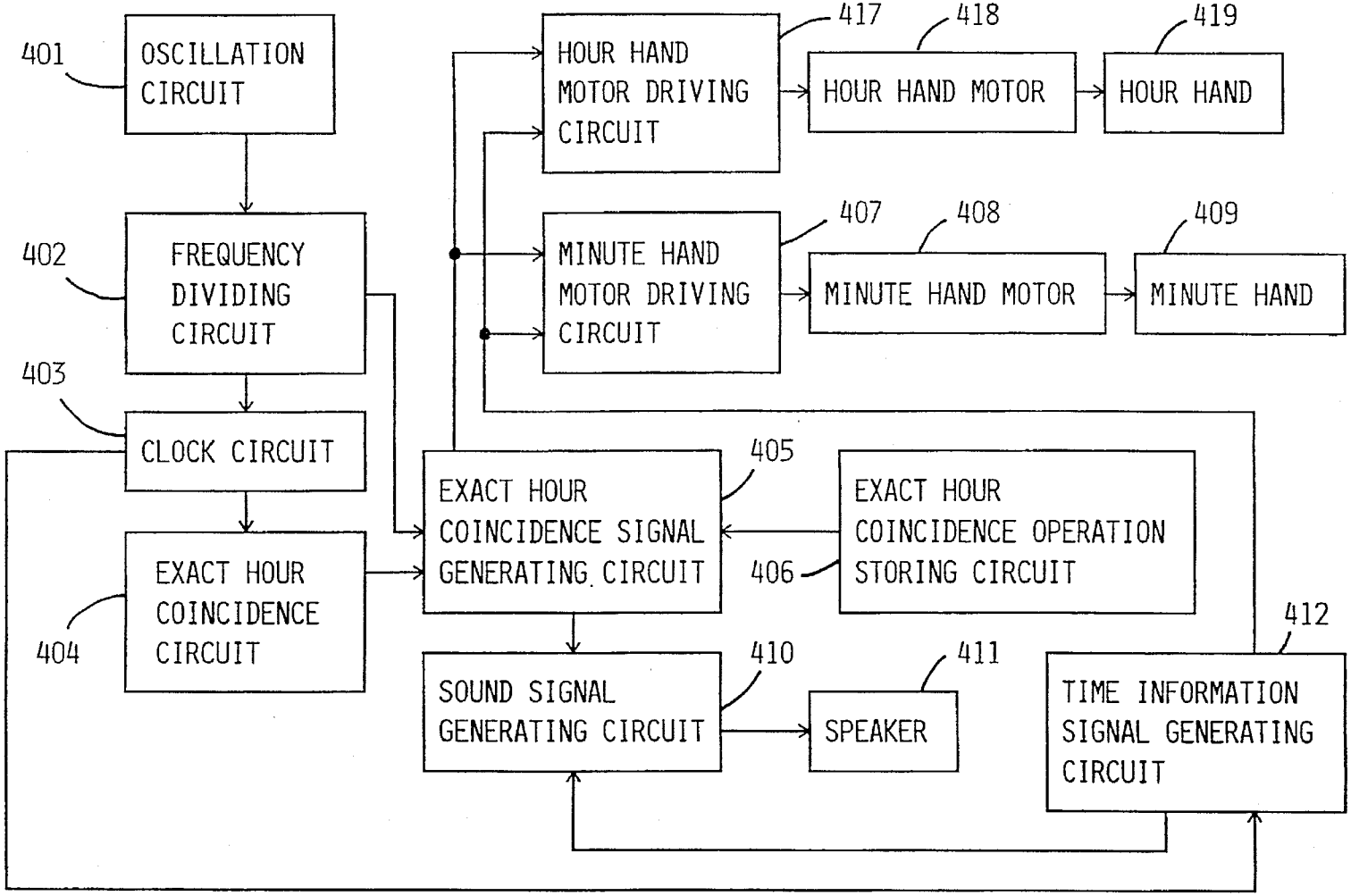
FIG. 4 shows a block diagram of a first embodiment of the present invention.

FIG. 4 is a function block diagram of a first embodiment of the present invention.

An oscillation circuit 401 oscillates at an oscillation frequency of 32768 Hz by application thereto of a predetermined voltage of 1.57 V.

A frequency dividing circuit 402 frequency divides the oscillation frequency outputted from the oscillation circuit 401 into arbitrary frequencies of 1 Hz, 8 Hz, 16 Hz, and 32 Hz.

A clock circuit 403 counts seconds of time using an arbitrary frequency of for example 1 Hz produced by the frequency dividing circuit 402, and counts the numeric value of minute digit and hour digit of time by consecutively adding one to second digit.

A time information signal generating circuit 412 inputs time information counted by the clock circuit 403, and outputs a hand driving operation signal to a minute hand motor driving circuit 407 every twelve seconds and to an hour hand motor driving circuit 417 every three minutes.

Further, at times of coincidence with an alarm time or a key operation, the time information signal generating circuit 412 outputs a sound generation signal to a sound signal generating circuit 410. Note that the hand driving cycle and output conditions for sound can be arbitrarily set.

When the time information counted by the clock circuit 403 is a exact hour such as for example 8:00:00, an exact hour coincidence circuit 404 outputs a starting signal for an exact hour coincidence operation to an exact hour coincidence signal generating circuit 405. Note that the outputting of the operation starting signal is not limited to coincidence with an exact hour, but may be at a time coinciding with a plurality of predetermined times, such as a time of exactly 30 minutes, a time of exactly 10 minutes, or a time of exactly 5 minutes.

Further, it is possible to set the conditions for performing judgement of hour coincidence. For example, providing a mode for performing judgement of hour coincidence, it is possible not to perform judgement of exact hour coincidence unless in that mode. In this case, the exact hour coincidence operation can be removed unless necessary, selection of the use thereof by the user being possible. In addition, current consumption due to the exact hour coincidence operation can be suppressed.

An exact hour coincidence operation storing circuit 406 stores operational sequences and the number of operation steps for the hands and sound at times of exact hour coincidence.

Upon input of a starting signal of an exact hour coincidence operation from the exact hour coincidence circuit 404, the exact hour coincidence signal generating circuit 405 inputs an operational sequence and number of operation steps of the hands and the sound at the time of exact hour coincidence from the exact hour coincidence operation storing circuit 406. Then the exact hour coincidence signal generating circuit 405 outputs a hand driving operation generating signal to an hour hand motor driving circuit 417 and minute hand motor driving circuit 407, and a sound output operation generation signal to a sound signal generating circuit 410 at timings synchronized with the frequency signal produced by the frequency dividing circuit 402, to control hand movement and sound generation.

Upon input of a sound generation signal from each of the exact hour coincidence signal generating circuit 405 and a time information signal generating circuit 412, the sound signal generating circuit 410 outputs a sound generating signal to a speaker 411 to generate a sound.

Upon input of a hand driving operation generation signal from each of the exact hour coincidence signal generating circuit 405 and the time information signal generating circuit 412, the hour hand motor driving circuit 417 drives the hour hand 419 through the hour hand motor 418.

Upon input of a hand driving operation signal from each of the exact hour coincidence signal generating circuit 405 and the time information signal generating circuit 412, the minute hand motor driving circuit 407 drives the minute hand 409 through the minute hand motor 408.

In this first embodiment, two hand driving motors and two hand driving motor driving circuits each are provided, as a result of which the hour hand and the minute hand can be driven simultaneously in their respectively separate motions. It is possible to realize more dynamic hand movement operation and a higher degree of motion than with one each.

For example, also in the case where manual hands obtained by printing a pictorial design of characters on the face of the timepiece and designing the tip of the hour and minute hands into a hand shape are used. It is possible to simultaneously move the two hands differently, realizing more real motions such as, for example, waving both hands "bye-bye", applause, etc.

Also, in this first embodiment, one motor for driving the hands and hand driving motor driving circuit for hand movement operation each can be provided. In this case, it is possible to manufacture a timepiece with fewer parts and further simplify the structure of the timepiece compared to the case where two or more each are provided.

Further, current consumption can be suppressed to a smaller value than in the case of using a plurality of motors.

Figure 5:
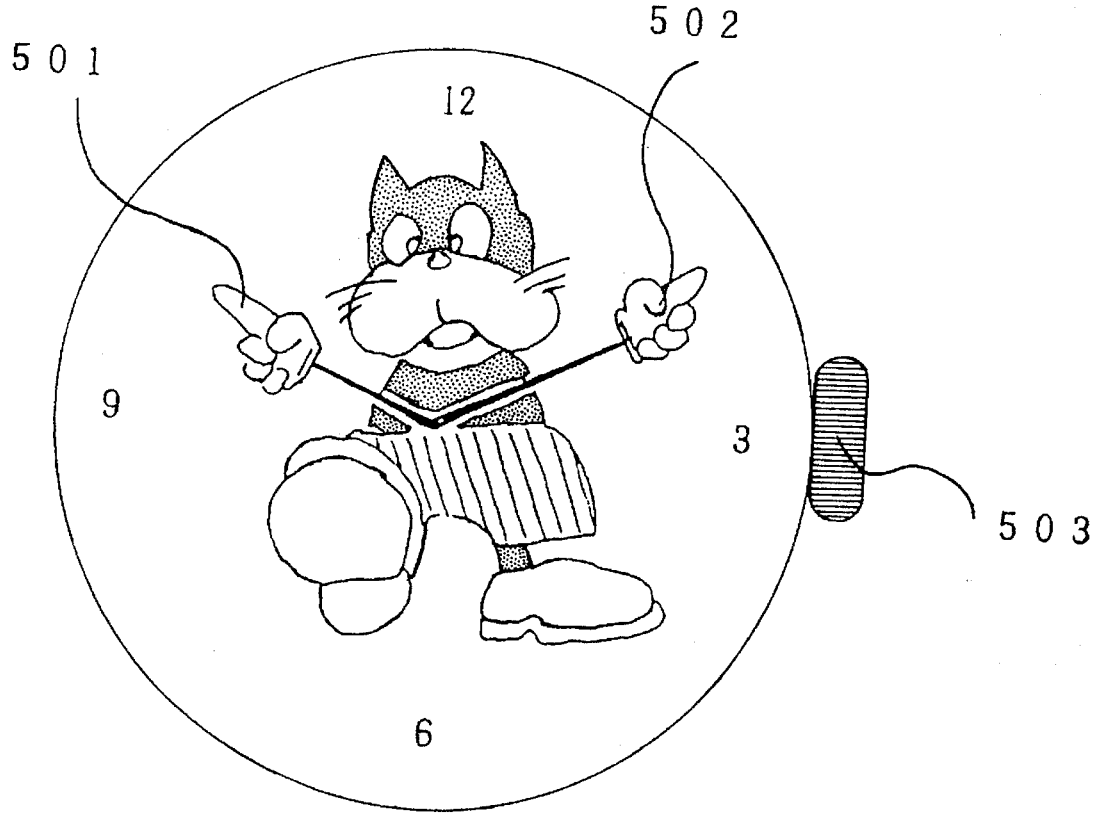
FIG. 5 shows a front view of a timepiece of the first embodiment of the present invention.

FIG. 5 is a front view of a timepiece which performs the exact hour coincidence operation of the first embodiment.

Figure 6:
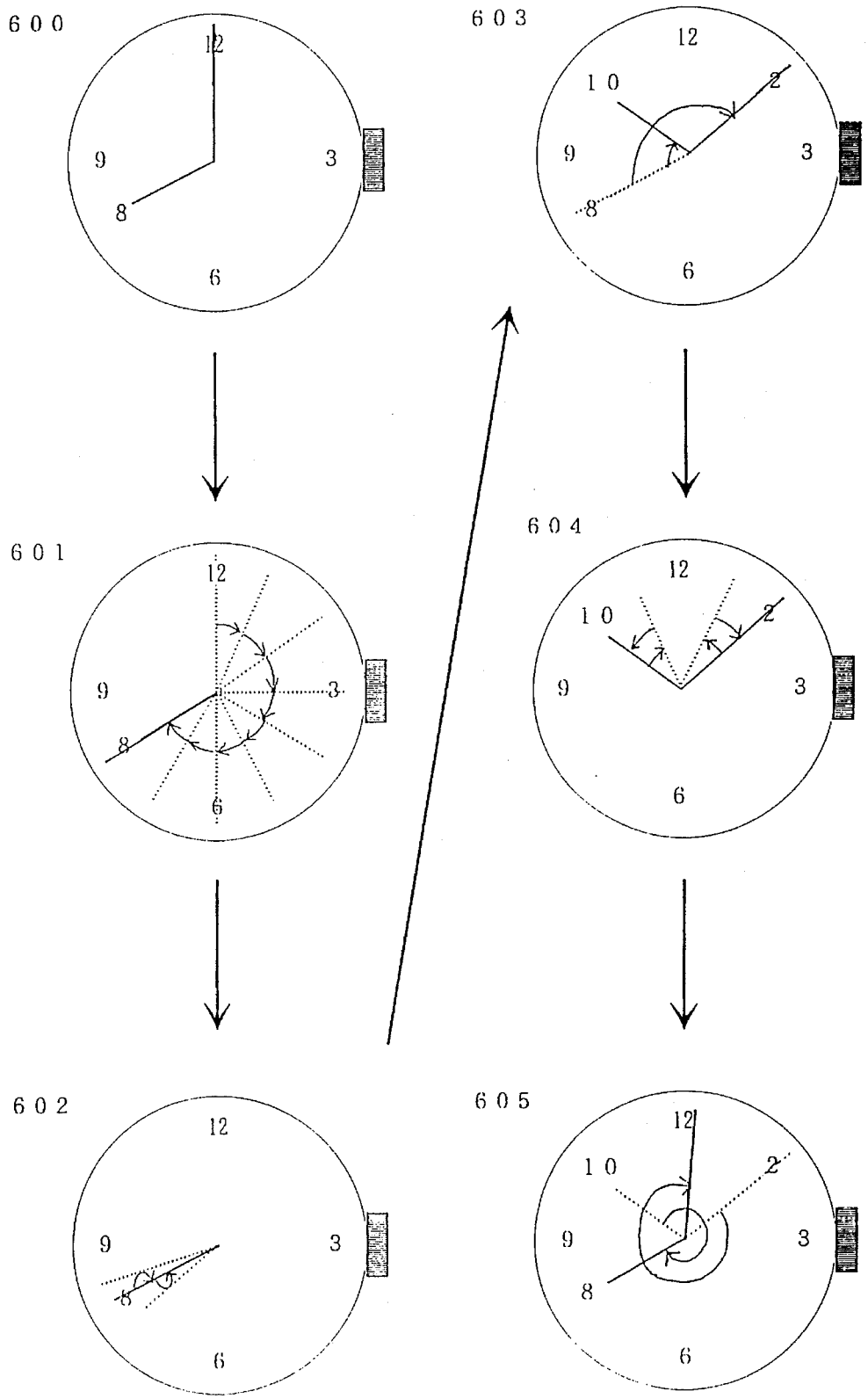
FIG. 6 shows an operational sequence of the first embodiment of the present invention.

FIG. 6 is a view showing an example of the operational sequence of the exact hour coincidence operation of the first embodiment.

FIG. 7 is a hand movement operational step table showing an example of operational steps for the exact hour coincidence operation of the first embodiment.

In FIG. 5, the timepiece has an hour hand 501 and a minute hand 502 for indicating time. These hands 501, 502 are driven by their respectively separate motors and motor driving circuits. The minute hand 502 is driven at 300 steps per one round while the hour hand 501 is driven at 240 steps per one round in a time display state.

In FIGS. 6 and 7, when the timepiece shows exactly 8:00 (hand movement step 600), the minute hand 502 is driven clockwise every 25 steps until it overlaps the hour hand 501. At this time, every 25 steps of the minute hand 502 driven, an envelope-equipped buzzer sound (hereinafter called "envelope sound") of 718.75 msec is generated eight times as a chime. Thereby, the exact hour is informed by the number of the envelope sound and the steps of the minute hand 502 (hand movement step 601). In this case, repetition number "H" in FIG. 7 is eight.

The hour hand 501 is driven counterclockwise and the minute hand 502 clockwise in 10 steps each centering on the position where both hands overlap, in such a manner that each of the hands swings about that position. At this time, each time the hands overlap each other, the envelope sound is generated (hand movement step 602).

The minute hand 502 and the hour hand 501 are each driven clockwise to the 10-minute position and to the 10 o'clock position (hand movement step 603).

The minute hand 502 is driven counterclockwise from the 10-minute position and the hour hand 501 is driven clockwise from the 10 o'clock position, so that they swing in 20 steps each. At this time, each time the drive directions of the hands are altered, a buzzer sound of 31.25 msec is generated (hand movement step 604).

The minute hand 502 and the hour hand 501 are each driven clockwise from the 10-minute position and the 10 o'clock position to the present-time position (hand movement step 605). At this time, the hands correct the difference of the exact hour coincidence operation starting time from the present time.

In the above hand movement step 603 and hand movement step 605, as other hand driving directions there are a driving method of driving each of the hour hand 501 and the minute hand 502 counterclockwise, a driving method of driving the hour hand 501 clockwise and the minute hand 502 counterclockwise, a driving method of driving the hour hand 501 counterclockwise and the minute hand 502 clockwise, and a driving method of driving the hour hand 501 and the minute hand 502 so that the driving times are fastest.

Note that in the case of the driving method in which the driving directions of the hour hand 501 and the minute hand 502 are fixed there is the advantage that the software process is simplified but there is the disadvantage that the driving time of the hands lengthens according to a time coinciding with the exact hour or a position of the hands prior to driving.

Conversely, in the case of the driving method in which the hour hand 501 and the minute hand 502 are driven so that the driving times are fastest, the movement has high operational efficiency and current consumption is advantageous, but there is the problem that the software process becomes complicated and the load increases due to the software volume.

Although in the above operational embodiment a single given operational sequence has been explained, since the hour hand 501, minute hand 502, and sound generation operation can be arbitrarily combined and each of these combinations can be arbitrarily set, the number of possible operational sequences is unlimited.

Further, although in the above first embodiment the hands driven by the two motors and two motor driving circuits are a combination of the hour hand 501 and the minute hand 502, the types of hands driven can also be arbitrarily set in such a manner that one set of motor and motor driving circuit drives the hour and minute hands in interlocking relation with each other, while the other set of a motor and a motor driving circuit drives the second hand.

Furthermore, by using three sets of motors and motor driving circuits, the three hands—hour hand, minute hand, and second hand—can each also be separately moved.

(2) Second Enbodiment of the Present Invention

Figure 8:
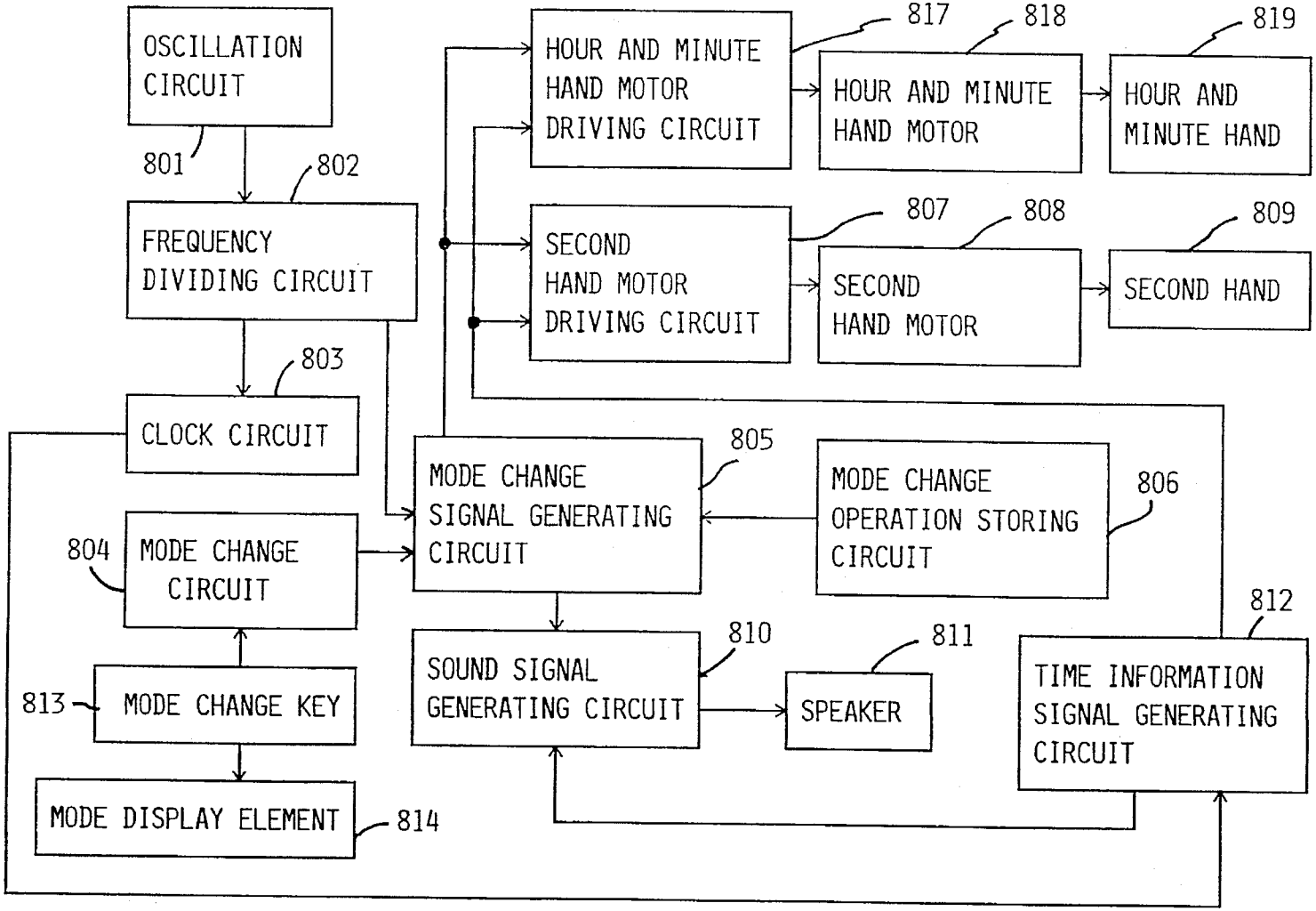
FIG. 8 shows a block diagram of a second embodiment of the present invention.

FIG. 8 is a functional block diagram showing a second embodiment of the present invention.

An oscillation circuit 801 oscillates at an oscillation frequency of 32768 Hz by application thereto of a predetermined voltage of 1.57 V.

A frequency dividing circuit 802 frequency divides the oscillation frequency outputted from the oscillation circuit 401 to arbitrary frequencies of 1 Hz, 8 Hz, 16 Hz, and 32 Hz.

A clock circuit 803 counts seconds by using a given frequency of for example 1 Hz produced by the frequency dividing circuit 802, and counts minute digits and hour digits by consecutively adding these second digits.

A time information signal generating circuit 812 inputs time information counted by the clock circuit 803, and outputs a hand driving operation signal to a second hand motor driving circuit 807 every second and to an hour and minute hand motor driving circuit 817 every ten seconds. Further, at times of coincidence with an alarm set time or key operation, the circuit 812 outputs a sound generation signal to a sound signal generating circuit 810. Note that the hand driving cycle and sound generating conditions can be arbitrarily set.

A mode change key 813 generates a mode change signal by a manual operation and outputs information thereof to a mode display element 814 and a mode change circuit 804. As the mode change key, there are a button switch, crown switch, etc.

The mode display element 814 displays the mode information outputted from the mode change key 813.

A mode change circuit 804 inputs the mode change signal outputted from the mode change key 813, and outputs mode information to the time information signal generating circuit 812 and a starting signal of a mode change operation to a mode change signal generating circuit 805.

A mode change operation storing circuit 806 stores operational sequences and the number of operation steps of the hands and the sound at times of mode change.

Upon input of the mode change operation starting signal from the mode change circuit 804, the mode change signal generating circuit 805 inputs the operational sequence and number of operation steps for the hands and sound at the time of mode change from the mode change operation storing circuit 806. Then the mode change signal generating circuit 805 outputs a hand driving operation signal to an hour and minute motor driving circuit 817 and a second hand motor driving circuit 807, and a sound generation signal to the sound signal generating circuit 810 at timings synchronized with a frequency signal produced by the frequency dividing circuit 802, to control hand movement and sound generation.

Upon input of sound generation signals from the mode change signal generating circuit 805 and the time information signal generating circuit 812, the sound signal generating circuit 810 outputs a sound generating signal to a speaker 811 to generate a sound.

Upon input of a hand driving operation signal from the mode change signal generating circuit 805 and the time information signal generating circuit 812, the hour and minute hands motor driving circuit 817 drives the hour and minute hands 819 through an hour and minute hands motor 818.

Upon input of a hand driving operation signal from the mode change signal generating circuit 805 and time information signal generating circuit 812, the second hand motor driving circuit 807 drives the second hand 809 through a second hand motor 808.

In this second embodiment, there are two motors and motor driving circuits each for driving the hands. As a result, the hour and minute hands and the second hand can be driven simultaneously in separate motions and the second hand only can be driven, making it possible to realize more dynamic hand movement operation and a higher degree of motion than with one each.

Further, in this second embodiment, one motor and motor driving circuit each for driving all the hands can be provided. In this case, it is possible to manufacture a timepiece with a reduced number of parts and simplify the function of the timepiece compared to the case of two or more. Furthermore, current consumption can be suppressed to less than in the case of using a plurality of motors.

Figure 9:
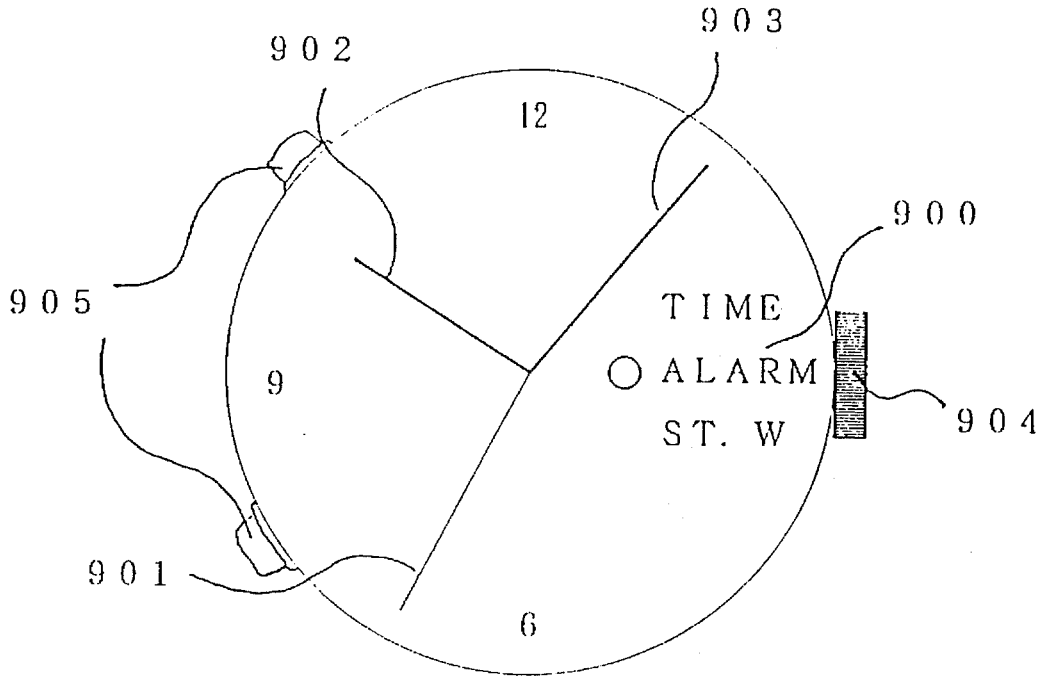
FIG. 9 shows a front view of a timepiece of the second embodiment of the present invention.

FIG. 9 is a front view of a timepiece wherein a mode change operation of the second embodiment is performed.

Figure 10:
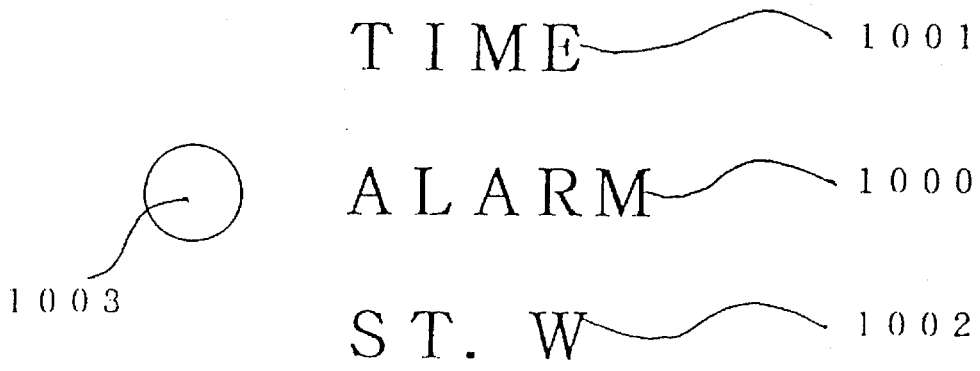
FIG. 10 shows a mode display portion of the timepiece of the second embodiment of the present invention.

FIG. 10 shows a mode display portion on a dial of the timepiece wherein the mode change operation of the second embodiment is performed.

The mode print on the mode display portion 900 is such that a TIME mode print 1001 is colored red, ALARM mode print 1000 is colored green, and ST.W mode print 1002 is colored blue. A mode display window 1003 is so formed that the present mode state can be judged by comparing the color visible from the mode display window with each mode print color.

Figure 11:
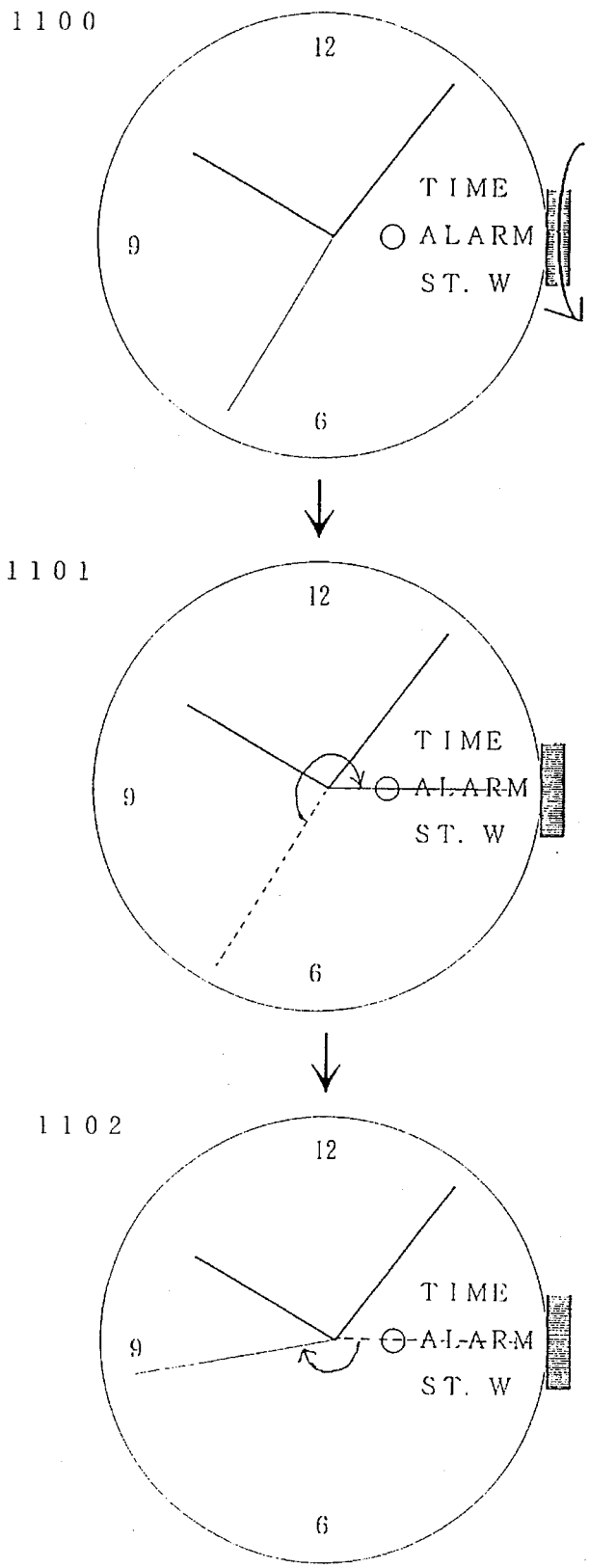
FIG. 11 shows an operational sequence of the second embodiment of the present invention.

FIG. 11 shows an example of the operational sequence for the mode change operation according to the second embodiment.

As shown in FIG. 9, the timepiece has three modes and the mode display portion 900 for displaying such modes on the face. A second hand 901 and a set of an hour hand 902 and minute hand 903 for indicating time are driven respectively by separate motors and separate motor driving circuits. The second hand 901 is driven at 60 steps per one round, and the hour hand 902 is driven at 4320 steps per one round interlocking with a minute hand 903 in the time display mode.

When a mode change has been performed by a crown switch 904 or button switches 905 from the TIME mode to the ALARM mode (hand movement step 1100), a buzzer sound of 31.25 msec generates and the second hand 901 is moved to the ALARM print portion 1000 on the mode display portion 900 of the face to indicate the new mode. At that time, the color seen in the mode display window of the mode display portion changes from red to green (hand movement step 1101).

After the second hand 901 indicates the new mode for three seconds, the second hand 901 is driven clockwise and then restored to a time indicating state (hand movement step 1102).

When, during the mode change operation, a normal step timing for the hour hand 902 and minute hand 903 is reached, the hour hand 902 and minute hand 903 are driven according to that timing.

In the hand movement step 1102, as a method by which the second hand 901 is restored to the time display mode, there are a method by which the second hand 901 is restored counterclockwise, a method by which the second hand 901 is driven in the direction in which the hand driving time length is shortest, a method by which the second hand 901 is kept still until the present time coincides with the indicated time on the mode print portion 900, etc., these methods being able to be arbitrarily set.

Further, in the hand movement step 1102, the time length during which the second hand 901 is indicating a relevant mode is not limited to three seconds but may be arbitrarily set.

The position of the mode display portion 900 is not limited to the 3 o'clock position on the dial but may be arbitrarily set to, for example, a 12 o'clock position, 6 o'clock position, 9 o'clock position, etc. Further, the method by which the mode is displayed is not limited to the mode display window but may also be a method which uses a mode display hand.

Although in the above-mentioned operation embodiment a single given operational sequence has been explained, since the hour and minute hands 819 and the second hand 809, as well as the sound generating operation, can be arbitrarily combined and each of these combinations can be arbitrarily set, the number of possible operational sequences is unlimited.

Further, although in the above-mentioned second embodiment the hands driven by the two motors and two motor driving circuits are a combination of the hour and minute hands 819 and the second hand 809, the types of hands driven can also be arbitrarily set in such a manner that one set of a motor and motor driving circuit drives the hour hand and another set of a motor and motor driving circuit drives the minute hand, as in the case of the operation described in the first embodiment. Furthermore, by using three sets of motors and motor driving circuits, the three hands of hour hand, minute hand, and second hand can also be separately moved.

(3) Third Enbodiment of the Present Invention

Figure 12:
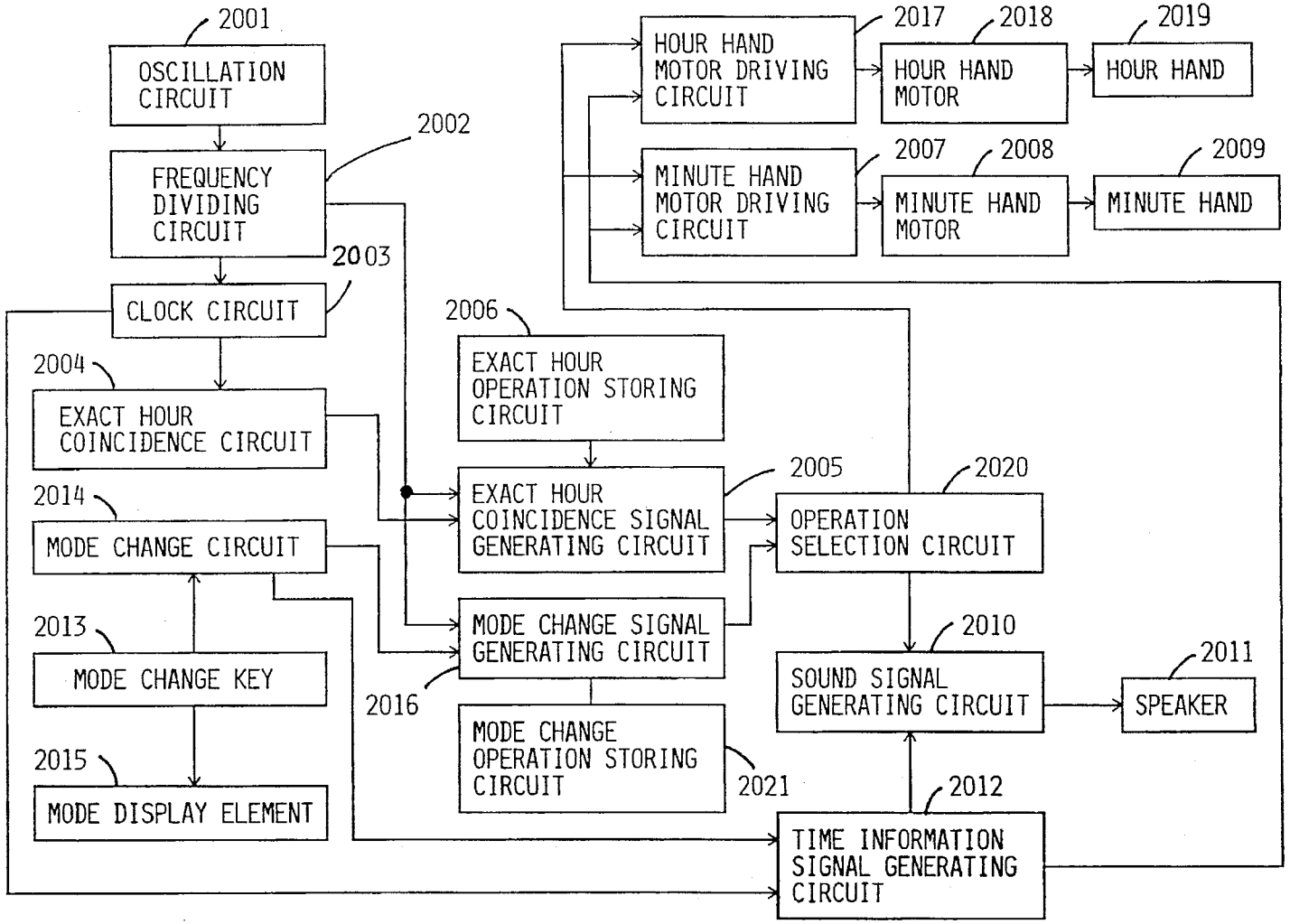
FIG. 12 shows a block diagram of a third embodiment of the present invention.

FIG. 12 is a functional block diagram of a third embodiment of the present invention.

In this third embodiment, the hour coincidence informing function according to the first embodiment and the mode change informing function according to the second embodiment are both incorporated into one timepiece.

In this embodiment, an operation selection circuit 2020 inputs an exact hour coincidence signal outputted from an exact hour coincidence signal generating circuit 2005 at an exact hour coincidence time and a mode change operation signal outputted from a mode change signal generating circuit 2016. The operation selection circuit 2020 performs judgment as to which operation is preferentially executed.

As a result, the order of priority of the operations can be arbitrarily set in the following ways, for example.

In a case where, during an exact hour coincidence operation, a mode change operation is performed, the exact hour coincidence operation is interrupted at that time and the mode change operation is instead performed. In a case where, during a mode change operation, the present time coincides with an exact hour coincidence, the mode change operation is interrupted at that time and the exact hour coincidence operation is instead performed. Namely, the operation signal as later output is priority executed.

Alternatively, in a case where, during an exact hour coincidence operation, a mode change operation is executed, the exact hour coincidence operation is first executed and after completion thereof the mode change operation is executed.

Further, although, in this embodiment, time information is performed when exact hour coincidence has been obtained, the time informing operation is not limited to a time corresponding to an exact hour, but may be performed at a time corresponding to a plurality of preset times, such as a time of exactly 30 minutes, a time of exactly 10 minutes, or a time of exactly 5 minutes.

Further, it is possible to set the conditions for performing judgement of exact hour coincidence. For example, providing a mode for performing an exact hour coincidence operation, it is also possible not to perform judgement of exact hour coincidence unless in that mode.

As explained above, the present invention provide an advantageous analog electronic timepiece having a function by use of which a plurality of predetermined times as well as a mode change can be visually informed so that they are easily understood by hand movement and sound generation.

Moreover, the electronic timepiece can be produced without complicating the function even for a small timepiece such as a wrist watch.

What is claimed is:

1. An analog electronic timepiece comprising:

at least two hands for indicating time;

at least one motor for driving said hands;

at least one motor driving circuit for driving said motor;

a mode change key for manually inputting a mode of the timepiece and outputting a mode change signal;

a sound signal generating circuit for outputting a sound generating signal to a speaker to generate a sound;

an oscillation circuit for producing and outputting a high-frequency standard signal;

a frequency dividing circuit for frequency dividing the standard signal outputted from said oscillation circuit into predetermined frequency signals;

a clock circuit for counting time information in response to the predetermined frequency signals outputted from said frequency dividing circuit;

a time information signal generating circuit for outputting an operation signal for informing the time information to said motor driving circuit and said sound signal generating circuit in response to the time information counted by said clock circuit;

a judgement circuit for judging a predetermined condition to output a starting signal of hand movement and generation of sound;

an information operation storing circuit for storing and reading out a preselected number of hand movement operation steps and frequencies of sound generation; and an information signal generating circuit for producing timing signals for driving the hands and generating sound in response to the starting signal, and outputting an operation generation signal to said motor driving circuit and/or said sound signal generating circuit according to the preselected number of hand movement operation steps and frequencies read out from said information operation storing circuit.

2. An analog electronic timepiece according to claim 1; wherein said judgement circuit comprises a time coincidence circuit for judging when the time information counted by said clock circuit coincides with a preset time and outputting a starting signal of a time coincidence operation;

wherein said information operation storing circuit comprises a time coincidence operation storing circuit for storing and reading out a preselected number of hand movement operation steps and frequencies for a time coincidence operation; and wherein said information signal generating circuit comprises a time coincidence signal generating circuit for producing timing signals and outputting a time coincidence operation signal.

3. An analog electronic timepiece according to claim 1; wherein said judgement circuit comprises a mode change circuit for judging when the mode change signal has been outputted from said mode change key and outputting a starting signal of a mode change operation;

wherein said information operation storing circuit comprises a mode change operation storing circuit for storing and reading out a preselected number of hand movement operation step and frequencies for a mode change operation; and wherein said information signal generating circuit comprises a mode change signal generating circuit for producing timing signals and outputting a mode change operation signal.

4. An analog electronic timepiece according to claim 1; wherein said judgement circuit comprises a time coincidence circuit for judging when the time information counted by said clock circuit coincides with a preset time and outputting a starting signal of a time coincidence operation, and a mode change circuit for judging when the mode change signal has been outputted from said mode change key and outputting a starting signal of a mode change operation;

wherein said information operation storing circuit comprises a time coincidence operation storing circuit for storing and reading out a preselected number of hand movement operation steps and frequencies for a time coincidence operation, and a mode change operation storing circuit for storing and reading out a preselected number of hand movement operation steps and frequencies for a mode change operation; and wherein said information signal generating circuit comprises a time coincidence signal generating circuit for producing timing signals and outputting a time coincidence operation signal, and a mode change signal generating circuit for producing timing signals and outputting a mode change operation signal.

5. An analog electronic timepiece according to claim 4; further comprising an operation selection circuit for receiving the time coincidence operation signal outputted from the time coincidence signal generating circuit, receiving the mode change operation signal outputted from the mode change signal generating circuit, judging which of the time coincidence operation and the mode change operation is to be preferentially executed, and for outputting an operation generating signal to the motor driving circuit and/or the sound signal generating circuit.

6. An analog electronic timepiece according to claim 1; wherein said motor and said motor driving circuit are each one in number.

7. An analog electronic timepiece according to claim 1; wherein said motor and said motor driving circuit are each two in number.

8. An analog electronic timepiece according to claim 2; wherein said time coincidence circuit performs judgement of time coincidence only at a predetermined mode.

9. An electronic timepiece comprising:

frequency signal generating means for generating and outputting different frequency signals;

time counting means for counting time information in response to the frequency signals outputted by the frequency signal generating means;

sound signal generating means for generating and outputting a sound signal to generate a sound;

time indicating means including at least two hands for indicating time;

driving means for driving the hands;

time information signal generating means for outputting an operation signal for informing the time information counted by the time counting means to the driving means and to the sound signal generating means;

judgment circuit means for judging a predetermined condition to output a starting signal for starting hand movement and sound generation; and signal generating means responsive to the starting signal for generating and outputting an operation generation signal to the driving means to control the driving of the hands and/or to the sound signal generating means to control the generation of sound.

10. An electronic timepiece according to claim 9; wherein the driving means comprises at least one motor for driving the hands, and at least one motor driving circuit for driving the motor.

11. An electronic timepiece according to claim 9; wherein the driving means comprises two motors each driving one of the hands, and two motor driving circuits each driving one of the motors.

12. An electronic timepiece according to claim 9; wherein the frequency signal generating means comprises an oscillation circuit for producing and outputting a high-frequency standard signal, and a frequency dividing circuit for frequency dividing the standard signal into the frequency signals.

13. An electronic timepiece according to claim 9; wherein the signal generating means includes storing means for storing and reading out a preselected number of hand movement operation steps and frequencies of sound generation; and wherein the information signal generating means outputs the operation generation signal according to the preselected number of hand movement operation steps and frequencies read out from the information operation storing means.

14. An electronic timepiece according to claim 13; wherein the judgement circuit means comprises a time coincidence circuit for judging when the time information counted by time counting means coincides with a preset time and outputting a starting signal of a time coincidence operation; the information operation storing means comprises a time coincidence operation storing circuit for storing and reading out the preselected number of hand movement operation steps and frequencies for a time coincidence operation; and the information signal generating means comprises a time coincidence signal generating circuit for producing timing signals and outputting a time coincidence operation signal.

15. An electronic timepiece according to claim 13; further comprising a mode change key for manually inputting a mode of the timepiece and outputting a mode change signal.

16. An electronic timepiece according to claim 15; wherein the judgement circuit means comprises a mode change circuit for judging when the mode change signal has been outputted from the mode change key and outputting a starting signal of a mode change operation; and wherein the information operation storing means comprises a mode change operation storing circuit for storing and reading out a preselected number of hand movement operation steps and frequencies for a mode change operation; and the information signal generating means comprises a mode change signal generating circuit for producing timing signals and outputting a mode change operation signal.

17. An electronic timepiece according to claim 15; wherein the judgement circuit means comprises a time coincidence circuit for judging when the time information counted by the time counting means coincides with a preset time and outputting a starting signal of a time coincidence operation, and a mode change circuit for judging when the mode change signal has been outputted from the mode change key and outputting a starting signal of a mode change operation; and wherein the information operation storing means comprises a time coincidence operation storing circuit for storing and reading out a preselected number of hand movement operation steps and frequencies for a time coincidence operation, and a mode change operation storing circuit for storing and reading out a preselected number of hand movement operation steps and frequencies for a mode change operation; and the information signal generating means comprises a time coincidence signal generating circuit for producing timing signals and outputting a time coincidence operation signal, and a mode change signal generating circuit for producing timing signals and outputting a mode change operation signal.

18. An electronic timepiece according to claim 17; further comprising operation selection means for receiving the time coincidence operation signal outputted from the time coincidence signal generating means, receiving the mode change operation signal outputted from the mode change signal generating circuit, judging which of the time coincidence operation and the mode change operation is to be preferentially executed, and outputting an operation generating signal to the driving means and/or the sound signal generating means.

* * * * *